United States Patent [19]

Brun et al.

[11] Patent Number: 4,991,262

[45] Date of Patent: Feb. 12, 1991

[54] LUBRICATING DEVICE FOR THE REVOLVING FLAT ARRANGEMENT OF A CARDING MACHINE

[75] Inventors: Erwin Brun, Dietwil; Peter Schmalz, Hochdorf; Karl Papp, Ebikon, all of Switzerland

[73] Assignee: Maschinenfabrik Rieter AG, Winterthur, Switzerland

[21] Appl. No.: 417,895

[22] Filed: Oct. 6, 1989

[30] Foreign Application Priority Data

Oct. 6, 1988 [DE] Fed. Rep. of Germany ..... 3834041

[51] Int. Cl.[5] ..... D01G 15/24; F16N 7/14; F16N 15/02

[52] U.S. Cl. ..... 19/111; 184/101; 184/16; 19/102

[58] Field of Search ..... 19/102, 111; 184/15.1, 184/17, 98, 99, 9, 10, 16, 45.1, 90, 91, 101, 109; 252/11, 18, 16, 52 A; 65/24

[56] References Cited

U.S. PATENT DOCUMENTS

| | | | |
|---|---|---|---|
| 276,987 | 5/1883 | Winter | 184/101 |
| 837,774 | 12/1906 | Baird et al. | 184/101 |
| 1,075,941 | 10/1913 | Reed | 184/101 |
| 1,192,762 | 7/1916 | Dodge | 184/15.1 |
| 1,914,093 | 6/1933 | Adams | 184/15.1 |
| 2,558,370 | 6/1951 | Miller | 184/15.1 |
| 2,589,582 | 3/1952 | Strughold et al. | 184/99 |
| 2,678,112 | 5/1954 | McDaniel | 184/15.1 |
| 4,127,491 | 11/1978 | Reick | 252/16 |
| 4,619,345 | 10/1986 | Rands | 184/109 |
| 4,901,820 | 2/1990 | Fey et al. | 184/101 |

FOREIGN PATENT DOCUMENTS

| | | | |
|---|---|---|---|
| 874102 | 8/1961 | United Kingdom | 184/99 |
| 1315371 | 5/1973 | United Kingdom | 19/102 |

*Primary Examiner*—Werner H. Schroeder
*Assistant Examiner*—John J. Calvert
*Attorney, Agent, or Firm*—Burns, Doane, Swecker & Mathis

[57] ABSTRACT

A lubricating device for the revolving flat arrangement of a carding machine having two chains arranged at the sides of the card and engaging ends of the revolving flats. The chains move in a loop and are guided by stationary guides at least in the area of the card cylinder and slide surfaces of the flats slide along these guides. At least one lubricant container is provided at each side of the revolving flat arrangement and is responsible for the dosed lubrication of the sliding surfaces. A rotatable transfer element associated with the appropriate lubricant container comes into contact with the lubricant and the sliding surfaces and is driven from the appropriate chain via a gear wheel.

35 Claims, 6 Drawing Sheets

LUBRICATING DEVICE FOR THE REVOLVING FLAT ARRANGEMENT OF A CARDING MACHINE

FIELD OF THE INVENTION

The present invention relates to a lubricating device for a revolving flat arrangement of a carding machine, with which two chains, arranged at the sides of the carding machine and engaging ends of the revolving flats, move in a loop and are guided by stationary guides at least in the area of the card cylinder, with slide surfaces of the flats sliding along these guides.

BACKGROUND

As the quality of the guides and the slide surfaces of the revolving flats determine the clearances between the points of the needle clothing of the card cylinder and the points of the needle clothing of the revolving flats, it is desirable to minimize wear on the guides and the slide surfaces, as wear of this kind leads to an alteration in the clearances which have been set. The wearing of the guides, and the slide surfaces can be considerably reduced by the application of a lubricant. The application of a lubricant, however, is extremely difficult, as the metered quantity of lubricant per unit of time must be determined exactly, in order to avoid superfluous lubricant on the one hand or the consequent wearing of the guides and slide surfaces on the other hand. Superfluous lubricant is undesirable for a variety of reasons. Such reasons include the risk of contamination of the very fine card web and the tendency of the lubricant to bind with dust and airborn fibers, which can lead, in the end, to clogging or overloading of the revolving flat arrangement.

SUMMARY OF THE INVENTION

According to the invention, at least one lubricant container is provided on both sides of the revolving flat arrangement. A rotatable transfer element associated with the respective lubricant container contacts both the lubricant and the slide surfaces of the flats and is responsible for the metered lubrication of the slide surfaces. A gear wheel driven by the respective chain drives the transfer element.

Preferred arrangements in accordance with the invention can in use serve to produce a lubrication device which is maintenance free over a long period, with low production costs and which operates reliably, above all, in the sense that the metered quantity of lubricant per unit of time can be maintained within prescribed limits over a long period.

When the revolving flats have internal and external slide surfaces on both ends, then separate lubricant containers and transfer systems are preferably provided for the internal and external slide faces, whereby each transfer system comprises a transfer element and an associated gear wheel.

Through the use of a transfer element, precise metering of the lubricant can be achieved in conjunction with the movement controlled by the chain drive. In a particularly preferred embodiment, the lubricant is provided in the form of graphite rods, especially graphite rods with a binding material, such as wax, for example.

Through a careful selection of the binding material, the hardness of the graphite rod can be so chosen that only very small quantities are taken up by the transfer element and transferred to the slide surfaces. With a solid lubricant such as a graphite rod, the transfer element is, preferably a rotatable brush, the bristles of which transfer the graphite from the graphite rod to the sliding surfaces.

This embodiment of the lubricating device has the particular advantage that the rotational speed of the brush can be so selected that the bristles of the brush can transfer the graphite to the slide surfaces in minimum quantities by a kind of dabbing action. In other words, there must not be a large discrepancy between the circumferential speed of the tips of the bristles of the brush and the velocity of motion of the sliding surfaces of the flats passing by the brush.

In this embodiment, the gear wheel can be fitted co-axially to the axle of the brush. This arrangement is very simple to realize, as the gear wheel and the brush can be manufactured with the same diameter, so that the desired speed matching results.

In an especially preferred embodiment, the surface speed of the brush is chosen to be slightly less than the velocity of motion (speed) of the slide surfaces past the brush and, for instance, the surface speed of the brush can be in the range of 50% to 95%, and in particular about 90%, of the velocity of motion of the slide surfaces.

Through the difference in the speed, a certain slip results between the bristles of the brush and the slide surfaces, which is advantageous for the lubrication of the slide surfaces. At the same time, superfluous lubricant is removed from the slide surfaces by the bristles of the brush, so that uniformity of the lubrication is assured. The desired slip can be achieved through the fact that the slide surfaces come into contact with the brush radially inside the pitch circle of the gear wheel.

An especially preferred embodiment is characterized by the fact that the container is a tubular part which is formed to receive the graphite rod, the tubular part can be closed with a stopper, and a compression coil spring can be arranged between the stopper and the graphite rod for pre-loading the graphite rod in the direction of the brush, whereby the compression spring is arranged such that the initial stress of the spring remains at least substantially constant over the spring travel.

When changing the graphite rod, which happens relatively seldom in practice, it is only necessary to remove the stopper and the spring and to insert the new rod, after which the spring and stopper can be re-introduced into the tube.

In an alternative arrangement, the container can be a cylindrical cartridge which holds the graphite rod under spring pressure, the cartridge being connectable via a quick release fitting, such as a bayonet fitting, with a tubular part of the lubricating device.

In the foregoing embodiments, the tubular part for holding the brush and its axle are preferably fork shaped. This arrangement is very simple to realize and achieves a reliable mounting both for the axle as well as the brush, moreover, the axle is supported or held or journalled at two spaced apart locations by the two arms of the fork.

The pivot axles of the chain are preferably hollow and protrude on at least one side beyond the chain links, the flats being fastened to the pivot axles by screws running through the pivot axles. The gear wheel of the lubricating device comes into contact with the parts of the pivot axles which extend beyond the chain links or with bushes fitted to the pivot axles.

The invention is not limited to the use of graphite rods as the lubricant. For example, it is possible to use oil as the lubricant, and in this case, the transfer element is formed by a wheel rotatably journalled inside an oil retaining casing, at least one member being provided which contacts the surface of the transfer element to restrict the thickness of the oil film carried by the latter. The member is preferably a roller and the transfer element is preferably a transfer wheel.

The casing can be at least substantially U-shaped, with the opening of the U-shaped casing lying above the axle of rotation of the wheel supported by the casing. Furthermore, the casing with the transfer element contained therein can be resiliently pre-loaded against the slide surfaces of the revolving flats. The pre-loading ensures that the transfer wheel is always essentially preloaded against the sliding surfaces, which favours the even transfer of the lubricant. In this case, the U-shaped casing can be pivotally supported in the vicinity of one limb of the U and a bias spring can act at the other limb. The opening in the casing can be closed by a snap-on cap which has an opening for a surface region of the transfer wheel. The cap can have sealing lips pressed resiliently against the front of the transfer wheel and also optionally sealing lips pressed against the circumference of the transfer wheel. The sealing lips are especially important, because they not only prevent the undesired egress of oil but also the contamination of the oil through dust and the like. The casing can be equipped with an automatic replenishment system for the oil. The casing can have an inspection window for the visual determination of the oil level, or the casing can be made from transparent material.

BRIEF DESCRIPTION OF THE DRAWINGS

The invention will now be further explained with reference to the embodiments shown in the drawings, in which.

DETAILED DESCRIPTION OF PREFERRED EMBODIMENTS

Figure 1:
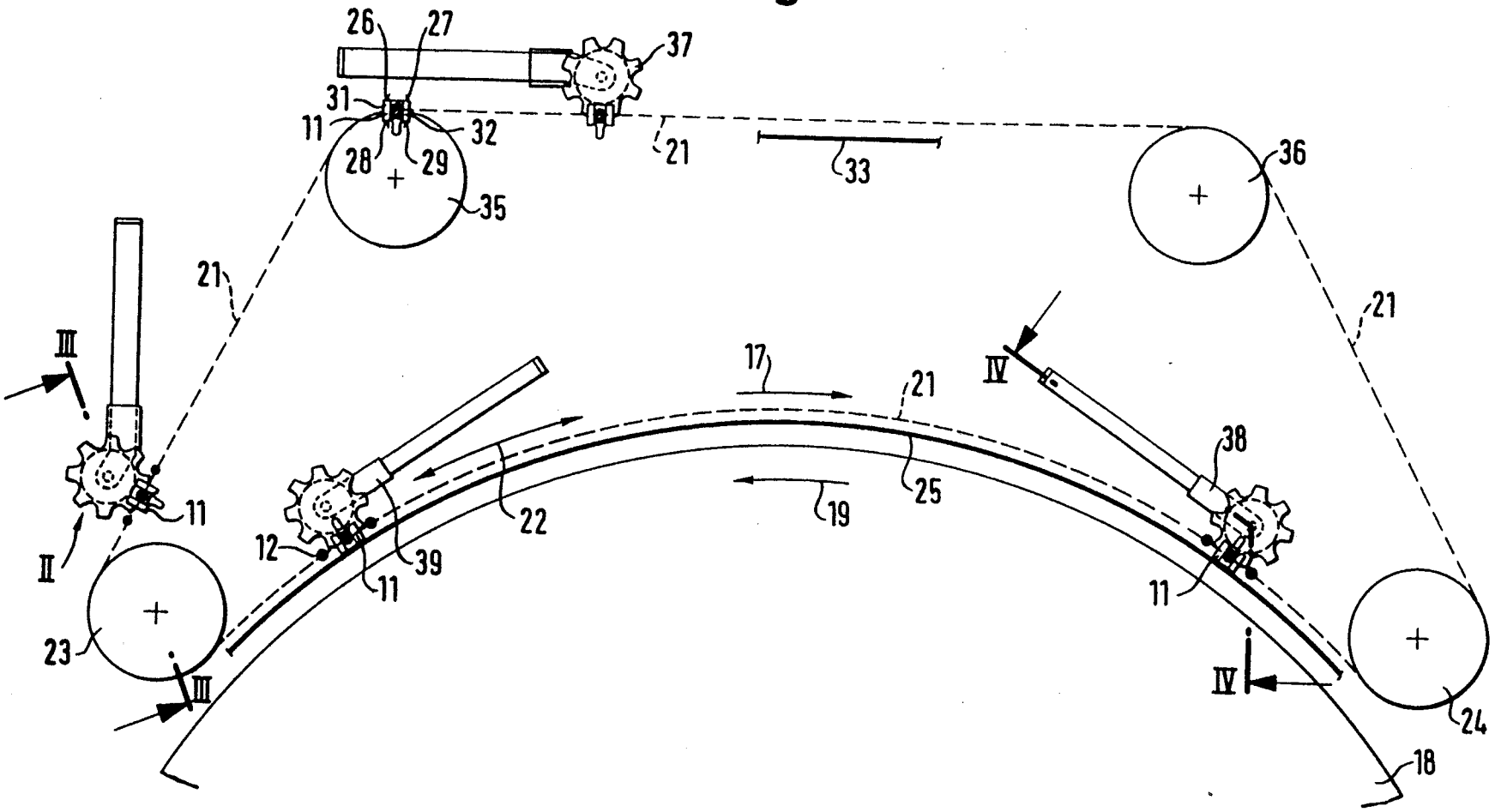
FIG. 1 shows a schematic side view of a revolving flat arrangement with a lubricating device according to the present invention utilizing solid lubricant.
Figure 5:
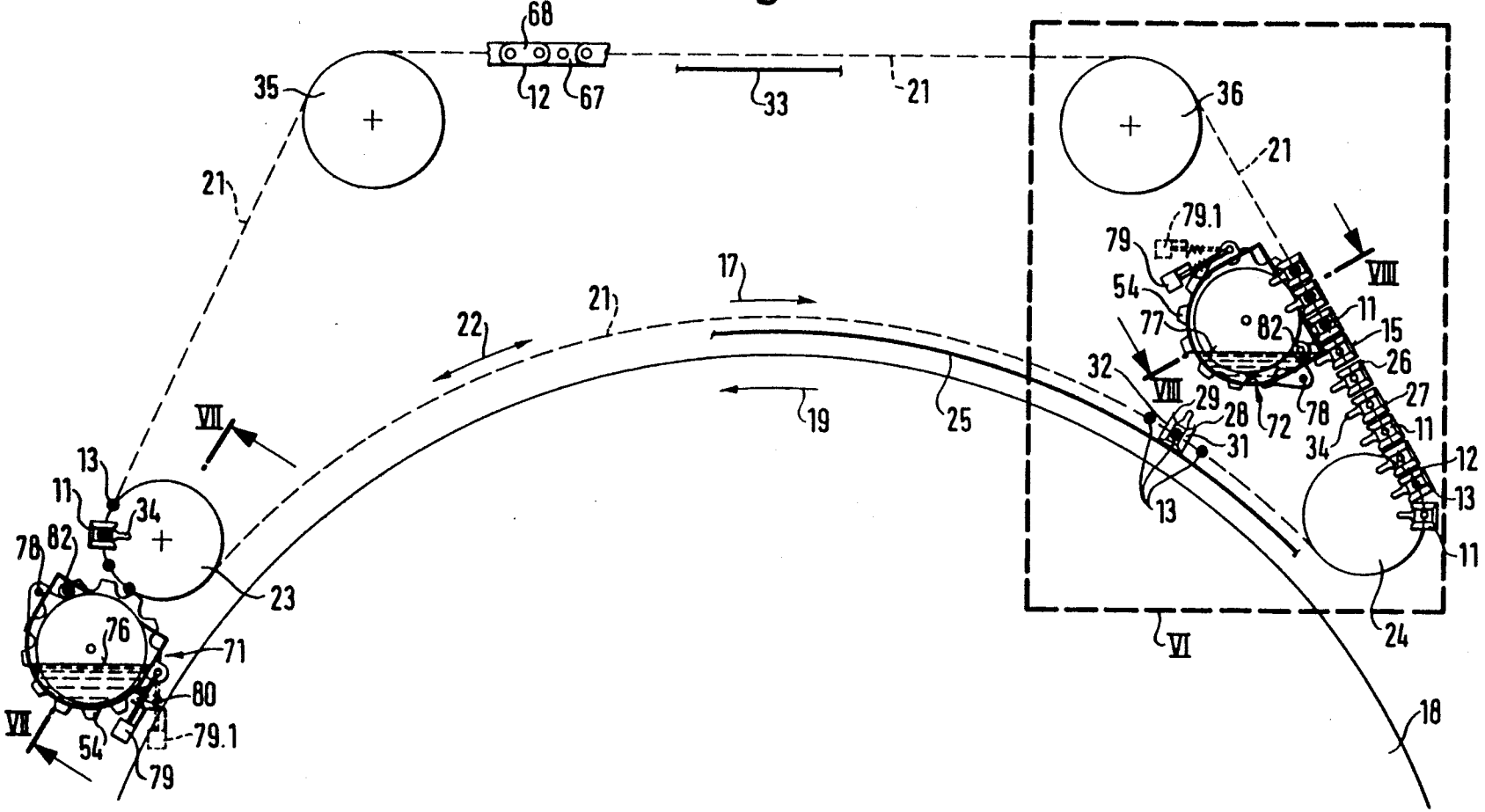
FIG. 5 shows a view similar to FIG. 1 but with an alternative embodiment of the lubricating device according to the invention utilizing oil lubrication.

FIGS. 1 and 5 show side views of the revolving flat arrangement of a card, wherein the version according to FIG. 1 shows a lubricating device with a solid lubricant such as graphite as the lubricant and wherein the embodiment of FIG. 5 is a lubricating device with a liquid lubricant such as oil as the lubricant.

As can be seen from FIG. 5 in particular, there is a plurality of revolving flats 11 (of which only some are shown) which extend perpendicularly to the plane of the drawing of FIGS. 1 and 5 essentially over the entire width of the card. Each revolving flat is fixed at its two ends to a respective circulating chain 12, only one of which is shown in FIGS. 1 and 5. The revolving flats are fastened to the chain 12 by means of threaded bolts 14, which pass through the hollow swivel axles (i.e. hinge pins 13) between the individual chain links.

Each revolving flat carries a needle clothing 16 on its outer surface 15, which can only be seen in FIGS. 3, 4, 5, 7 and 8, but not in FIGS. 1 and 5, whereby, during the circulatory movement of the chains and the revolving flats in the direction of arrow 17, this needle clothing runs past the corresponding needle clothing of a card cylinder 18 which turns in the direction of arrow 19. A dotted line 21 reproduces the path of movement of the geometrical axes of the hinge pins 13 of the chain 12 during the circulatory movement. In particular, a circular region 22 of this path of movement 21 between two sprocket guide wheels 23, 24, must be specified exactly, so that the needle clothing of the revolving flats maintains the clearance to the needle clothing of the card cylinder. This is achieved by circular guides 25 on both sides of the card, one of the guides 25 being represented only schematically in FIGS. 1 and 5.

As can be seen from these figures, each revolving flat has two external slide surfaces 26, 27, on each end, i.e. upstream and downstream ends with respect to the path of movement of the chain, which slide along the guide 25. Correspondingly, each revolving flat also has two internal slide surfaces 28, 29 on the internal ends of webs or crosspieces 31, 32 which slide along stationary guides 33 in other areas of the circulatory path. The stationary guides are only shown in part in FIGS. 5 and 1. As the internal slide surfaces 28, 29 carry less load than the external slide surfaces 26, 27, they are somewhat narrower in shape, which is clear from a comparison of FIGS. 3 and 4 or 7 and 8. In order to achieve adequate stiffness of the revolving flats 11, each revolving flat has a longitudinal rib 34 over its entire length.

As already explained, every chain is deflected over two sprocket guide wheels 23 and 24, which are in direct proximity to the card cylinder.

The circulatory movement of the chain 12 in the preset loop 21 is also determined by two further sprocket guide wheels 35, 36. The chain on the other side of the card is also guided over four identically arranged sprocket guide wheels. From the total of eight sprocket guide wheels, two opposite wheels, that is, one sprocket guide wheel on the left hand side of the card and one sprocket guide wheel on the right hand side of the card, are synchronously driven by a through going shaft so that the movements of the chains 12 are always synchronized and the revolving flats 11 always lie parallel to the axis of the card cylinder. Since either the two external slide surfaces 26, 27 or the two internal slide surfaces 28, 29 at each end of the revolving flat always lie on one guide, the longitudinal ribs 34 of the revolving flats are always perpendicular to the local path of movement.

Figure 2:
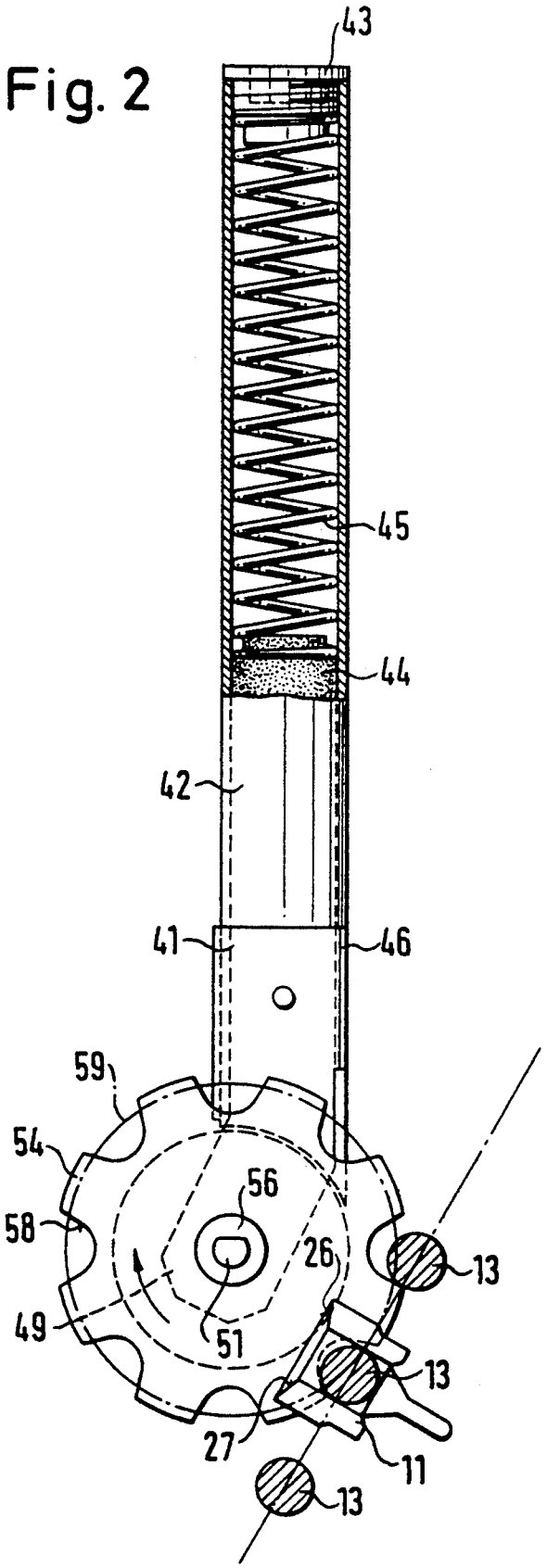
FIG. 2 shows an enlarged representation of the lubricating device which is indicated by the arrow II in FIG. 1.

FIG. 2 shows an enlarged representation of the lubricating device shown at II in FIG. 1. FIG. 1 shows three further lubricating devices 37, 38, 39. That is, the lubricating device shown at 37 is identical with the lubricating device II, but is mounted in a different position. The lubricating device 38 is formed in the same way as the lubricating device II, but with smaller dimensions, as it is responsible for the lubrication of the internal slide surfaces 28, 29. The lubricating device 39 is identical with the lubricating device 38, and only shows an alternative position of the same.

The precise construction of the lubricating device II will now be explained with reference also to FIGS. 2 and 3.

The lubricating device II comprises a tubular part 41, in which a tubular extension 42 is permanently fixed, for example, by welding. The tubular extension 42 is closed with a screw stopper 43 at its upper end and contains solid lubricant in the form of a graphite rod 44, which is pressed downwards by means of a compression coil spring 45. The compression coil spring 45 is located between the screw stopper and the one end face of the graphite rod 44 and is braced against the screw stopper 43. The tubular part is provided with two lugs 46 and 47 by which it is mounted on the card frame. On the lower end shown in FIG. 2, the tubular part 41 changes into the two arms of a fork 48, 49, which form an obtuse angle $\alpha$ of about 150° to the mid-longitudinal axis of the tubular part or the tubular extension 42. The two arms 48, 49 serve to support a rotary axle 51 on which a circular brush 52 with bristle tips 53 is fixedly mounted for rotation therewith. The axle 51 is extended outwards at one end beyond the side face of the appropriate arm 49 to carry a gear wheel 54 at this location. The gear wheel is fastened so that it is fixedly connected to the axle for rotation therewith by suitable means such as an appropriate form-locked arrangement. The axle itself is secured by two circlips 55 and 56 which fit into appropriate circumferential grooves in the axle 51 to prevent axial displacement of the axle 51 out of the arms 48, 49. A disc 57 made from polytetrafluoroethylene, or a similar material, is located between the gear wheel 54 and the arm 49 in order to reduce friction in this area.

The gear wheel 54 has recesses 58 on its outer circumference whereby the recesses 58 are arranged on a pitch circle 59 with a spacing which corresponds to the linear spacing between the hinge pins 13 of the chain.

Figure 3:
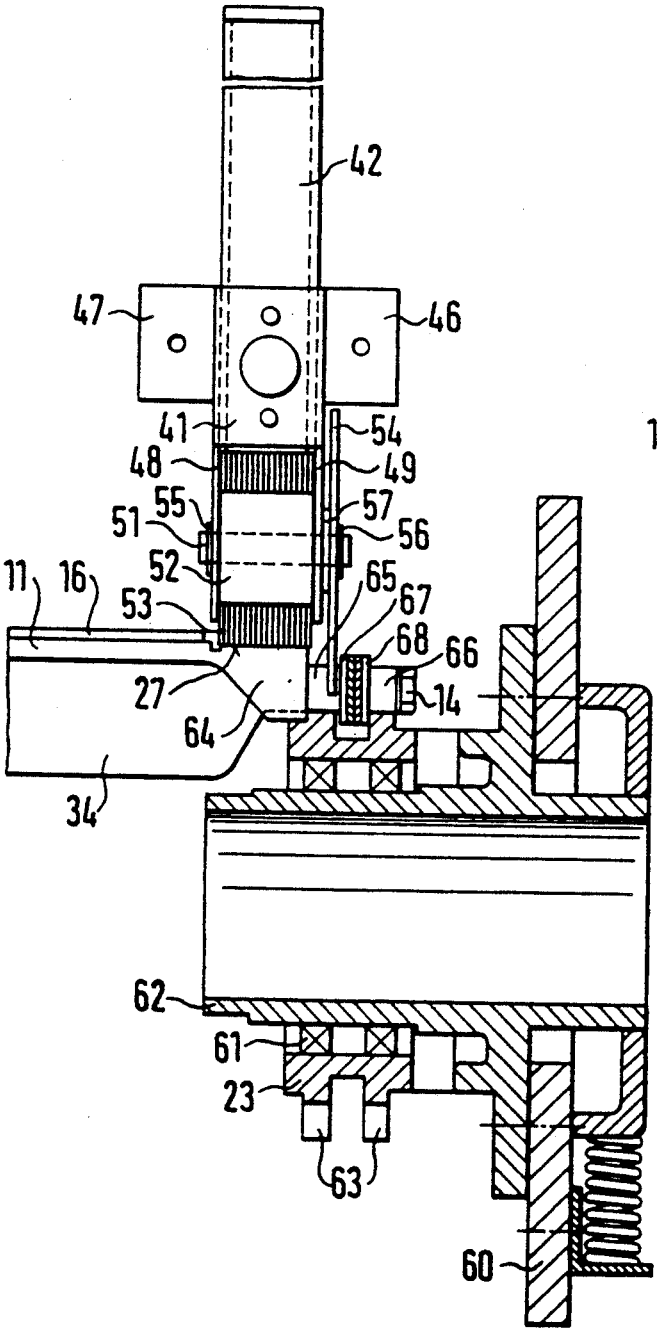
FIG. 3 shows a partly sectioned view of the lubricating device shown at II in FIG. 1 as taken along the sectional plane III—III in FIG. 1.

FIG. 3 shows additionally the sprocket guide wheel 23, which is rotatably supported via an appropriate bearing arrangement 61 by a tubular stub axle 62 on a card frame 60. The sprocket guide wheel 23 also has recesses 63, which are arranged at the spacing of the hinge pins 13 of the chains.

As already explained, each hinge pin 13 is hollow and is fixed to a respective end 64 of the revolving flat 11 by means of a threaded bolt 14 which passes through it. This fixing is so arranged that two cylindrical bushes 65 and 66 are rotatably supported on the actual hinge pin 13 and the chain links 67 and 68 are arranged between the two cylindrical bushes 65 and 66. The cylindrical bushes 65 and 66 engage into the recesses of the sprocket guide wheel 23, and the bush 65 also serves to drive the gear wheel 65.

The recirculating movement of the revolving flats 11 with the associated chains 12 leads to a rotary motion of the gear wheel 54, and thus of the brush 52, so that the tips of the bristles 53 take off graphite from the graphite rod 44 and transfer it to the exterior slide surfaces 26, 27. FIG. 3 also shows that the circumference of the brush 52, meaning the tips of the bristles 53, is somewhat smaller than the pitch circle 59, so that the tips of the bristles move a little more slowly than the revolving flat itself.

When the graphite rod 44 is completely used up, the stopper 43 and the spring 45 are removed and a new graphite rod is inserted. After replacing the stopper 43 and the spring 45, the lubricating device is immediately ready for service. The change can be undertaken during the operation of the card, as a short interruption of the lubricant feed is completely acceptable.

Figure 4:
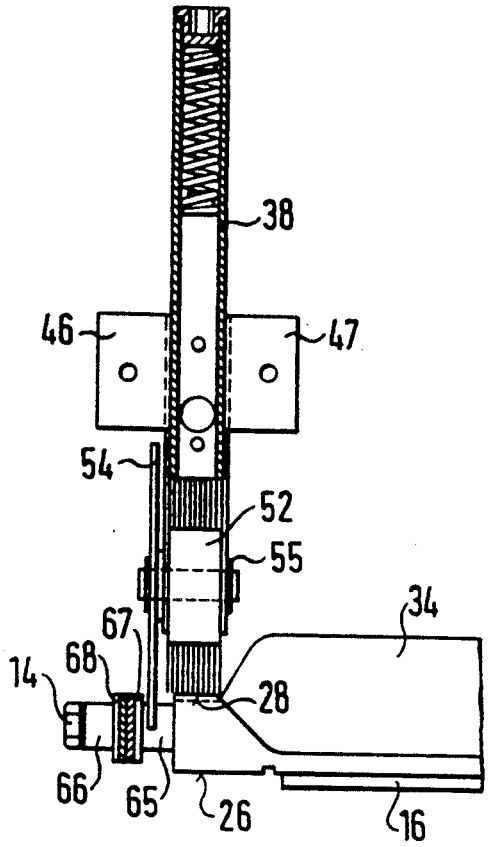
FIG. 4 shows a partly sectioned view of a further lubricating device shown in FIG. 1 for the lubrication of the interior sliding surfaces as taken along the sectional plane IV—IV in FIG. 1.

FIG. 4 shows how the smaller lubricating device 38 is used to lubricate the internal slide surfaces 28, 29. As the arrangement is very similar to that shown in FIG. 3 since the only differences lie in the dimensions (diameter and length of the tubular part and width of the brush), and as the same reference symbols are used as in FIG. 3, the mode of operation of FIG. 4 can be understood according to the foregoing description of FIG. 3.

The remaining description deals with a device for lubrication with a liquid such as oil, as shown in FIGS. 5, 6, 7 and 8. Similar parts of the lubricating device of these figures and the parts of the lubricating device of FIGS. 1 to 4 are all designated with the same reference symbols.

Figure 6:
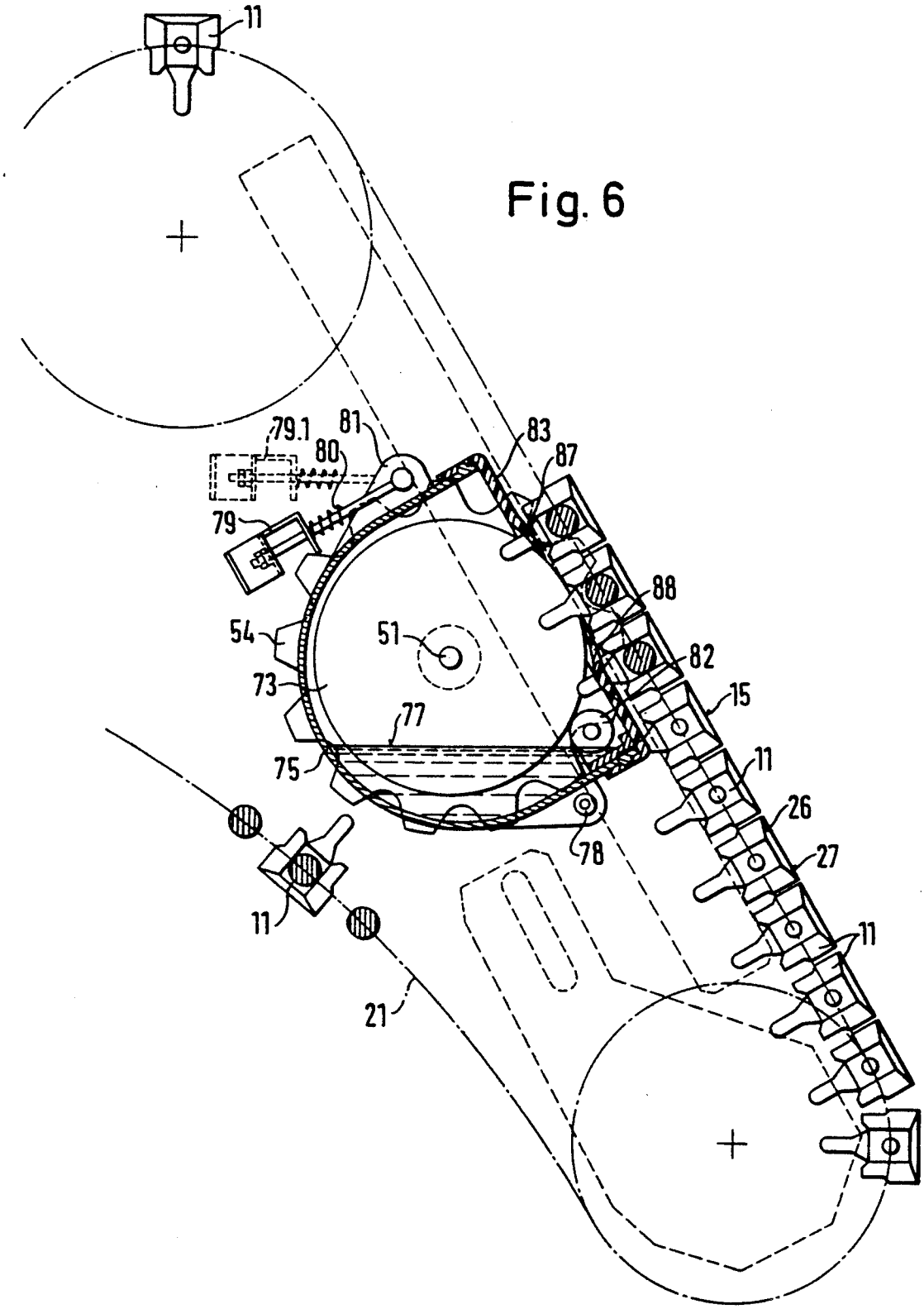
FIG. 6 shows an enlarged representation of the area shown by the dotted box VI in FIG. 5.
Figure 8:
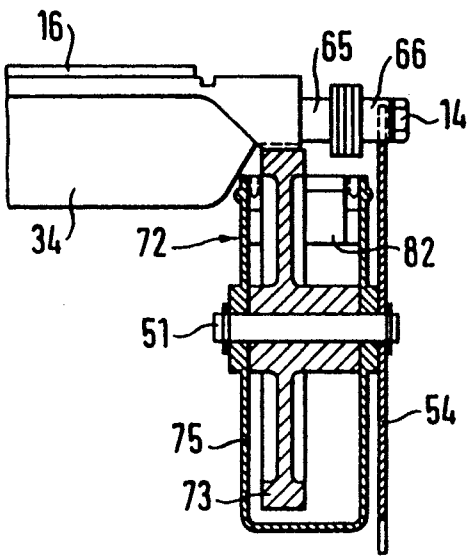
FIG. 8 shows a diagrammatic representation of the lubrication of the interior sliding surfaces of the revolving flats as taken along the sectional plane VIII—VIII in FIG. 5.
Figure 7:
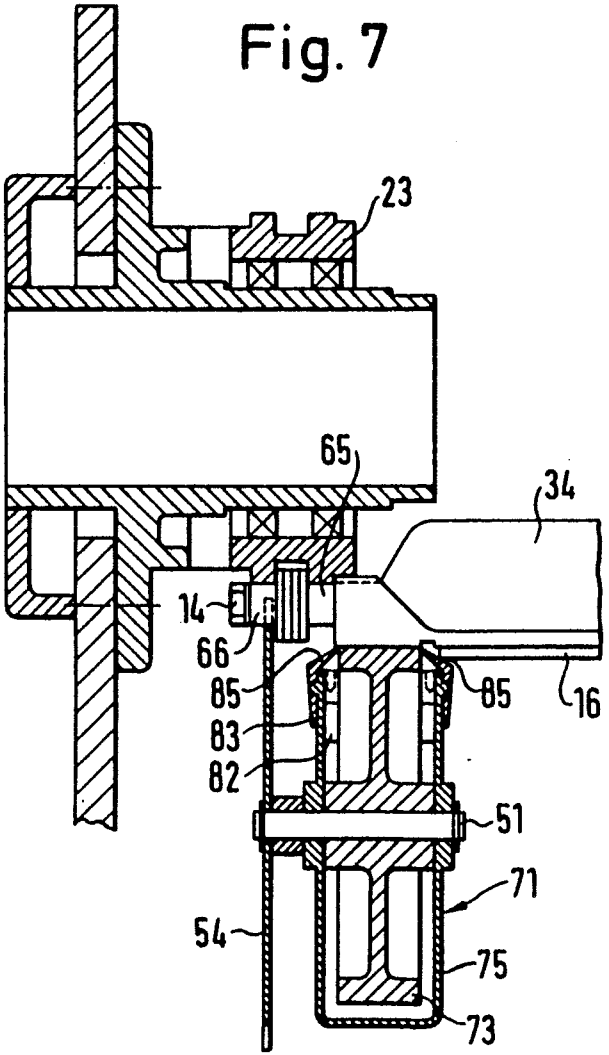
FIG. 7 shows a sectional illustration of the lubrication unit for the outer sliding surfaces of the revolving flats as taken along the sectional plane VII—VII in FIG. 5.

With the embodiment of FIG. 5, the necessity also exists for the lubrication of the external slide surfaces as well as the internal slide surfaces. In this case, a lubricating device 71 is responsible for the lubrication of the external slide surfaces and a lubricating device 72 is responsible for the lubrication of the internal surfaces. FIGS. 6 and 7 show the cooperation of the lubricating device 71 with the external slide surfaces, while FIG. 8 shows how the lubricating device 72 interacts with the internal slide surfaces. It can also be seen immediately that the lubricating devices 71, 72 are very similar in design. The only difference lies in the design of a transfer element 73, which in FIG. 8 is designed to be considerably more narrow at its outer circumference than in the embodiment of FIG. 7 in order to take account of the different widths of the internal and external slide surfaces.

As several parts of the lubricating device in FIGS. 5 to 8 are of the same design as the parts in FIGS. 1 to 4, the same reference symbols have been used for these parts and a detailed description of these parts is unnecessary.

The lubricating devices 71, 72 have a casing 75 which is approximately U-shaped and in both cases is of the same design. These casings 75 contain liquid lubricant such as oil as the lubricant, the surface of the oil in FIG. 5 being shown by the reference numbers 76 and 77. The height of the oil level can be maintained constant with any automatic replenishment system. The casing 75 can also be manufactured completely or partially from transparent material, so that a visual check of the oil level is possible. It is also completely feasible to replenish the oil manually from time to time, because of the very small quantities of oil used. The casings are so fitted in operation that the oil contained therein cannot flow out from the open end of the casing. The casing itself is pivotably fixed to the card frame via an axle 78 and is biased in the direction of the revolving flats by means of a spring loaded mounting device 79 which acts on a lug 81 on the other side of the casing from the pivot axle 78, so that the surface of the transfer wheel 73, here shown cylindrically, is pre-loaded against the internal slide surfaces or the external slide surfaces of the revolving flats, respectively. In order to minimize the oil transfer, the cylindrical surface of the transfer wheel can also be arched (in cross-section). Distribution of the lubricant along the slide surfaces results naturally through the sliding motion on the static guides.

From FIG. 5 it can be seen that the fastening device 79 can also be swivelled to the right to a position 79.1. In this position, the fastening of the casing is released, so that one end of the casing can be moved downwards for refilling or cleaning.

It should be especially noted that a small roller 82 is also supported so that it is rotatable in the casing in such a way that its axis of rotation lies parallel to the axis of the transfer wheel 73. The surface of the roller 82 contacts the surface of the transfer wheel 73 and ensures that only a very thin oil film exists on the external sliding surface of the transfer wheel, so that the metering of the lubricant on the sliding surfaces is achieved in very small quantities. The roller 82 could also be replaced by a wiping element. In FIG. 7, as well as in the version according to FIGS. 6 and 8, a plastic cap 83 is fitted on the open side of the casing 75 which is fastened to the casing through an appropriate snap closure. As can be seen from FIG. 7, this cap has sealing lips 85 on the side of the wheel 73, which, on the one hand, prevent the egress of oil at this location and, on the other hand, also prevent the penetration of dirt and the like into the lubricant container or the casing 75. As can also be seen from FIG. 6, the cap 83 has further sealing lips 87, 88 which lie on the external surface of the transfer wheel 73 and also prevent the entry of dust and dirt here.

In operation, the gear wheel 54 is driven by the chain 12, in this case by the cylindrical bushes 66 and not by the cylindrical bushes 65, and in turn drives the transfer wheel 73 via the axle 51. The transfer wheel 73 dips into the lubricant below the axis of the axle 51 and carries an oil film on its surface up to the roller 82, which wipes away superfluous oil through contact with the external surface, so that only a microscopically thin oil coating on the surface of the wheel 73 is transferred to the slide surfaces. The pre-loading of spring 80 ensures that the surface of the wheel with this very thin oil film always exerts an essentially constant pressure against the slide surfaces, so that a uniform oil transfer takes place even when the slide surfaces themselves do not come to rest exactly in the same place opposite the lubricating device, through differences caused by uneven wear. A pre-loading of this sort is not necessary with the version in FIGS. 1 to 4, as here the bristles themselves have a certain resilience in operation, and therewith, compensate for small deviations.

While the invention has been described with reference to the foregoing embodiments, changes and modifications may be made thereto which fall within the scope of the appended claims.

We claim:

1. A lubricating device for a revolving flat arrangement of a carding machine wherein a respective chain is provided on each side of the carding machine, the chains engaging ends of revolving flats which move in a loop and are guided by stationary guides at least in an area of a card cylinder, with slide surfaces of the flats sliding along the guides, the lubricating device comprising at least one lubricant container and transfer system provided along each side of the revolving flat arrangement, the transfer system including a rotatable transfer element associated with the respective lubricant container and which contacts both lubricant and the slide surfaces for providing metered lubrication of the slide surfaces and a gear wheel driving the transfer element, the gear wheel being driven by a respective one of the chains, the revolving flats having internal and external slide surfaces at opposite ends thereof, one of the lubricant containers and transfer systems being provided for the internal slide surfaces and another of the lubricant containers and transfer systems being provided for the external slide surfaces, respectively.

2. A lubricating device for revolving flat arrangement of a carding machine wherein a respective chain is provided on each side of the carding machine, the chains engaging ends of revolving flats which move in a loop and are guided by stationary guides at least in an area of a card cylinder, with slide surfaces of the flats sliding along the guides, the lubricating device comprising at least one lubricant container and transfer system provided along each side of the revolving flat arrangement, the transfer system including a rotatable transfer element associated with the respective lubricant container and which contacts both lubricant and the slide surfaces for providing metered lubrication of the slide surfaces and a gear wheel driving the transfer element the gear wheel being driven by a respective one of the chains, lubricant being provided in the container, the lubricant comprising graphite rods which include a binding material.

3. A lubricating device according to claim 2, wherein the transfer element is a rotatably mounted brush having bristles. the bristles having tips which transfer the graphite from the graphite rod to the slide surfaces.

4. A lubricating device according to claim 3, wherein the brush is mounted on an axle and the gear wheel is fitted coaxially to the axle of the brush.

5. A lubricating device according to claim 3, further comprising means for driving the brush such that a surface speed of the brush is less than a speed at which the slide surfaces move past the brush.

6. A lubricating device according to claim 3, wherein the slide surfaces contact the brush at a position located radially inside a pitch circle of the gear wheel.

7. A lubricating device according to claim 3, wherein the container includes a tubular part for receiving the graphite rod, a stopper for closing the tubular part, and a compression coil spring in the tubular part between the stopper and the graphite rod for pre-loading the graphite rod in the direction of the brush, whereby the compression spring is so arranged that the initial stress of the spring remains essentially constant over the spring travel.

8. A lubricating device according to claim 7, wherein an end of the tubular part facing the brush is fork shaped to accommodate the brush and an axle of rotation of the brush.

9. A lubricating device according to claim 2, wherein the binder comprises wax.

10. A lubricating device according to claim 5, wherein the means for driving the brush causes the surface speed of the brush to be about 50 to 95% of the speed that the slide surfaces moves past the brush.

11. A lubricating device according to claim 5, wherein the means for driving the brush causes the surface speed of the brush to be about 90% of the speed that the slide surfaces move past the brush.

12. A lubricating device for a revolving flat arrangement of a carding machine wherein a respective chain is provided on each side of the carding machine, the chains engaging ends of revolving flats which move in a loop and are guided by stationary guides at least in an area of a card cylinder, with slide surfaces of the flats sliding along the guides, the lubricating device comprising at least one lubricant container and transfer system provided along each side of the revolving flat arrangement, the transfer system including a rotatable transfer element associated with the respective lubricant container and which contacts both lubricant and the slide surfaces for providing metered lubrication of the slide surfaces and a gear wheel driving the transfer element, the gear wheel being driven by a respective one of the chains, the lubricant container comprising an oil retaining casing and the transfer element comprises a wheel rotatably journalled inside the oil retaining casing, at least one member being provided for contacting a surface of the transfer element to restrict thickness of an oil film carried by the surface of the transfer element.

13. A lubricating device according to claim 12, wherein the member comprises a roller.

14. A lubricating device according to claim 12, wherein the casing is at least substantially U-shaped, with an opening of the U-shaped casing lying above an axis of rotation of the wheel supported in the casing.

15. A lubricating device according to claim 14, wherein the casing with the transfer element contained therein is resiliently pre-loaded against the slide surfaces of the revolving flats.

16. A lubricating device according to claim 15, characterized in that the U-shaped casing is pivotally supported at one end thereof and a bias spring acts on another end thereof.

17. A lubricating device according to claim 14, wherein the opening in the casing is closed by a snap-on cap, the cap having an opening for exposing a surface region of the transfer wheel.

18. A lubricating device according to claim 17, wherein the cap includes sealing lips pressed resiliently against opposite axial ends of the transfer wheel.

19. A lubricating device according to claim 12, wherein the casing includes means for automatic replenishment of oil.

20. A lubricating device according to claim 12, wherein the casing includes an inspection window for visually determining an oil level in the casing.

21. A lubricating device according to claim 12, wherein the flats include internal and external slide surfaces of different widths, a respective one of the lubricant containers and transfer systems being provided for lubricating the internal slide surfaces and external slide surfaces, respectively, the casings comprising the lubricant containers being the same size and the respective transfer wheels being sized in accordance with respective widths of the associated slide surfaces.

22. A lubricating device according to claim 18, wherein the cap further includes sealing lips pressing resiliently against the surface region of the transfer wheel.

23. A lubricating device according to claim 12, wherein the casing comprises transparent material.

24. A lubricating device for a revolving flat arrangement of a carding machine wherein a respective chain is provided on each side of the carding machine, the chains engaging ends of revolving flats which move in a loop and are guided by stationary guides at least in an area of a card cylinder, with slide surfaces of the flats sliding along the guides, the lubricating device comprising at least one lubricant container and transfer system provided along each side of the revolving flat arrangement, the transfer system including a rotatable transfer element associated with the respective lubricant container and which contacts both lubricant and the slide surfaces for providing metered lubrication of the slide surfaces and a gear wheel driving the transfer element, the gear wheel being driven by a respective one of the chains, each of the chains including pivot axles which are hollow and protrude on at least one side beyond chain links of the chain, the pivot axles being fastened by screws running through the pivot axles to the revolving flats, the gear wheel being driven by the parts of the pivot axles which extend beyond the chain links.

25. A lubricating device according to claim 24, further comprising bushes mounted on the parts of the pivot axles which extend beyond the chain links, the bushes coming into contact with the gear wheel for driving the gear wheel.

26. A lubricating device for a revolving flat arrangement of a carding machine wherein a respective chain is provided on each side of the carding machine, the chains engaging ends of revolving flats which move in a loop and are guided by stationary guides at least in an area of a card cylinder, with slide surfaces of the flats sliding along the guides, the lubricating device comprising at least one lubricant container and transfer system provided along each side of the revolving flat arrangement, the transfer system including a rotatable transfer element associated with the respective lubricant container and which contacts both lubricant and the slide surfaces for providing metered lubrication of the slide surfaces and a gear wheel driving the transfer element, the gear wheel being driven by a respective one of the chains, the lubricant comprising a graphite rod and the container being a cylindrical cartridge which holds the graphite rod under spring pressure, the cartridge being connectable via a quick release fitting with a tubular part of the lubricating device, the quick release fitting being a bayonet fitting.

27. A lubricating device for a revolving flat arrangement of a carding machine wherein a respective chain is provided on each side of the carding machine, the chains engaging ends of revolving flats which move in a loop and are guided by stationary guides at least in an area of a card cylinder, with slide surfaces of the flats sliding along the guides, the lubricating device comprising at least one lubricant container and transfer system provided along each side of the revolving flat arrangement, the transfer system including a rotatable transfer element associated with the respective lubricant container and which contacts both lubricant and the slide surfaces for providing metered lubrication of the slide surfaces and a gear wheel driving the transfer element, the gear wheel being driven by a respective one of the chains, each of the flats including two internal slide surfaces and two external slide surfaces at each opposite end of the flats, a respective one of the lubricant containers and transfer systems being provided for a transferring lubricant to the internal surfaces of the flats and a respective one of the lubricant containers and transfer systems being provided for transferring lubricant to the external surfaces of the flats.

28. A lubricating device for metered lubrication of slide surfaces of flats forming part of a revolving flat arrangement of a carding machine wherein the flats are carried by two chains arranged at opposite sides of the carding machine, the revolving flats moving in a loop with slide surfaces being guided by stationary guides at least in the area of a card cylinder of the carding machine, the lubricating device being mountable along a path of movement of one of the chains, the lubricating device comprising:

lubricating means for providing a metered amount of lubricant to flats of a revolving flat arrangement of a carding machine when the lubricating device is installed along a path of movement of a chain carrying the flats, the lubricating means including a lubricant container, transfer means comprising a rotatable transfer element associated with the lubricant container for contacting both lubricant and the slide surfaces to provide metered lubrication of the slide surfaces, and driving means comprising a gear wheel for being driven by the chain and for driving the transfer element in rotation when the gear wheel is driven by the chain, the transfer element comprising a rotatably mounted brush having tips which contact the graphite rod and which contact the slide surfaces of the flats when the lubricating device is installed along the path of movement of the chain.

29. A lubricating device according to claim 25, wherein the lubricant container includes a part in which the graphite rod is received and means for pre-loading the graphite rod in a direction towards the brush.

30. A lubricating device according to claim 25, wherein the gear wheel includes a plurality of recesses, each of which is engageable with a respective hinge pin of the chain for driving the gear wheel in rotation as the chain moves along its path of movement, the recesses being arranged along a pitch circle which is located radially outwardly of the tips of the brush.

31. A lubricating device for metered lubrication of slide surfaces of flats forming part of a revolving flat arrangement of a carding machine wherein the flats are carried by two chains arranged at opposite sides of the carding machine, the revolving flats moving in a loop with slide surfaces being guided by stationary guides at least in the area of a card cylinder of the carding machine, the lubricating device being mountable along a path of movement of one of the chains, the lubricating device comprising:

lubricating means for providing a metered amount of lubricant to flats of a revolving flat arrangement of a carding machine when the lubricating device is installed along a path of movement of a chain carrying the flats, the lubricating means including a lubricant container, transfer means comprising a rotatable transfer element associated with the lubricant container for contacting both lubricant and the slide surfaces to provide metered lubrication of the slide surfaces, and driving means comprising a gear wheel for being driven by the chain and for driving the transfer element in rotation when the gear wheel is driven by the chain, the transfer element including a surface for transferring lubricant to the slide surfaces, the surface being driven by the driving means at a speed which is less than a speed at which the chain travels.

32. A lubricating device for metered lubrication of slide surfaces of flats forming part of a revolving flat arrangement of a carding machine wherein the flats are carried by two chains arranged at opposite sides of the carding machine, the revolving flats moving in a loop with slide surfaces being guided by stationary guides at least in the area of a card cylinder of the carding machine, the lubricating device being mountable along a path of movement of one of the chains, the lubricating device comprising:

lubricating means for providing a metered amount of lubricant to flats of a revolving flat arrangement of a carding machine when the lubricating device is installed along a path of movement of a chain carrying the flats, the lubricating means including a lubricant container, transfer means comprising a rotatable transfer element associated with the lubricant container for contacting both lubricant and the slide surfaces to provide metered lubrication of the slide surfaces, and driving means comprising a gear wheel for being driven by the chain and for driving the transfer element in rotation when the gear wheel is driven by the chain, the lubricant container being capable of storing a supply of liquid lubricant, the transfer element comprising a transfer wheel rotatably journalled inside the lubricant container.

33. A lubricating device according to claim 32, further comprising means for maintaining a thin film of liquid lubricant on the transfer wheel.

34. A lubricating device according to claim 33, wherein the means for maintaining the thin film of liquid lubricant on the transfer wheel comprises a roller which contacts an outer circumferential surface of the transfer wheel.

35.. A lubricating device according to claim 32, further comprising means for resiliently pre-loading the transfer wheel against the slide surfaces of the flats when the lubricating device is installed along the path of movement of the chain.

* * * * *